United States Patent [19]

Sakulevich et al.

[11] 4,175,930

[45] Nov. 27, 1979

[54] METHOD FOR FINISHING SURFACES OF NON-MAGNETIC ARTICLES BY MEANS OF FERROMAGNETIC ABRASIVE POWDER IN MAGNETIC FIELD

[76] Inventors: Faddei J. Sakulevich, pereulok Dalny, 3; Leonid K. Minin, ulitsa D. Serdicha, 54, kv. 47; Jury A. Bazarnov, ulitsa Golodeda, 51, korpus, kv. 72; Alexandr A. Baubel, 2 pereulok Bagrationa, 19, kv. 376; Nikolai Y. Skvorchevsky, ulitsa Karbysheva, 11, kv. 152, all of Minsk, U.S.S.R.

[21] Appl. No.: 900,517

[22] Filed: Apr. 27, 1978

[51] Int. Cl.[2] ..... B24B 31/00

[52] U.S. Cl. ..... 51/281 R; 51/161; 51/293; 51/317

[58] Field of Search ..... 51/7, 317, 117, 118, 51/289, 105 R, 293, 281 R, 313, 161

[56] References Cited

U.S. PATENT DOCUMENTS

| | | | |
|---|---|---|---|
| 1,930,788 | 10/1933 | Buckner | 51/293 |
| 2,880,554 | 4/1959 | Simjian | 51/281 R |
| 3,695,934 | 10/1972 | Feldhaus | 51/317 |
| 3,848,363 | 11/1974 | Lovness | 51/317 |

FOREIGN PATENT DOCUMENTS

| | | | |
|---|---|---|---|
| 403537 | 4/1974 | U.S.S.R. | 51/317 |
| 468769 | 9/1975 | U.S.S.R. | 51/317 |
| 488692 | 1/1976 | U.S.S.R. | 51/161 |
| 495190 | 3/1976 | U.S.S.R. | 51/161 |
| 508389 | 5/1976 | U.S.S.R. | 51/161 |

*Primary Examiner*—Donald J. Arnold
*Attorney, Agent, or Firm*—Fleit & Jacobson

[57] ABSTRACT

A method for surface finishing of non-magnetic articles by means of ferromagnetic abrasive powders in a magnetic field, wherein ferromagnetic powder is introduced into the magnetic field produced by oppositely positioned unlike poles of a magnetic system to form a cutting "brush" of the ferromagnetic abrasisve powder and non-magnetic articles are then placed into said magnetic field, said articles being moved relative to the cutting "brush" of the ferromagnetic powder. Additionally, each pair of non-magnetic articles is separated by a ferromagnetic body, the latter being moved relative to the cutting "brush" of the ferromagnetic abrasive powder so as to restore the cutttng "brush".

6 Claims, 4 Drawing Figures

METHOD FOR FINISHING SURFACES OF NON-MAGNETIC ARTICLES BY MEANS OF FERROMAGNETIC ABRASIVE POWDER IN MAGNETIC FIELD

The invention relates to abrasive treatment of articles and more particularly, to a method for finishing external surfaces of non-magnetic articles by means of ferromagnetic abrasive powder in a magnetic field.

The industry uses a wide variety of non-magnetic articles of the type of bodies of revolution with profiles of various complexity, whose finishing is labour-consuming and cannot be automatically controlled.

The invention may prove to be most advantageous for finishing of non-magnetic stomatological instruments.

Known in the art is a method for abrasive treatment of articles in a magnetic field, wherein an article is placed into a nonmagnetic container filled to a specified level with ferromagnetic abrasive powder and liquid. Electromagnetic coils are provided at two sides of the container to form a variable magnetic field, which moves the ferromagnetic abrasive powder relative to an article placed in the container.

The method fails to be effective for treating non-magnetic articles, since the highest gradient of magnetic field intensity is observed at the poles of the electromagnets, so that the magnetic abrasive powder is displaced to the poles of the electromagnets in the course of treatment, which lowers the productivity of the process and, as a result, gives an insufficient quality of finished surfaces. In addition, with each next article being treated, the ferromagnetic abrasive powder is compacted more and more at the poles and its mass in contact with the article diminishes, which results in a quick attenuation of the process of treatment with time.

The method cited is unsuitable for surface finishing of articles of an arbitrary profile, since the article cannot be moved as required.

The productivity of the cited method is not sufficiently high because of the need to maintain a specified mass of powder in the container in the course of treatment, since a reduction in the mass of powder diminishes the number of collisions of powder particles with the surface of article, whereas increasing the mass of powder above the specified level can limit its mobility. All this has an adverse effect on the quality of finished surface.

Attempts to increase the productivity of abrasive treatment of articles resulted in the development of methods for finishing non-magnetic articles by means of ferromagnetic abrasive powders in a magnetic field, for instance, the method of volume polishing of articles, according to which a ferromagnetic abrasive powder is placed into the magnetic field formed by unlike electromagnetic poles positioned oppositely along the length of a circle; the powder forms a cutting "brush" which fills the working zone confined within the surfaces of electromagnetic poles. Articles to be treated are then placed into said zone and brought into rotation on their axes, oscillating motion parallel to their axes, and translatory motion along the working zone.

The treatment of non-magnetic articles by the method cited results in the following: when moving along the working zone, an article moves along the ferro-magnetic abrasive powder and compacts it at the poles of the electromagnets, i.e. in the zone of the highest gradient of magnetic field intensity; this results in non-uniform distribution of the powder in the working zone, and therefore, in a reduced productivity when treating subsequent articles and in a poor quality of their surface.

An object of the invention is to increase the productivity of the method for finishing external surfaces of non-magnetic articles by means of ferromagnetic powders in a magnetic field by restoring the cutting "brush" of ferromagnetic powder in the course of the process.

With this and other objects in view, there is provided a method for finishing external surfaces of nonmagnetic articles by means of ferromagnetic abrasive powders in a magnetic field, wherein ferromagnetic abrasive powder is placed into an external magnetic field produced by magnets of unlike polarity to form a cutting "brush", said brush filling the working zone confined by the surface of the poles of said magnets. Non-magnetic articles are placed into said zone and caused to move relative to said "brush" of ferromagnetic abrasive powder. According to the invention, each pair of non-magnetic articles is spaced apart by a ferromagnetic body, the latter being moved relative to the "brush " of ferromagnetic abrasive powder.

The provision of a moving ferromagnetic body is favourable in restoring a uniform density of the cutting "brush" of ferromagnetic powder in the course of treatment of non-magnetic articles. The brush of ferromagnetic abrasive powder is restored owing to the fact that the ferromagnetic body, when placed into the external magnetic field, is magnetized and forms an unequipolar magnetic system between the poles of the external magnetic system and the surface of said ferromagnetic body; as a result, the ferromagnetic powder is attracted to the ferromagnetic body and its density in the working zone is restored. This ensures a better quality of finished surface of non-magnetic articles and a high productivity of the process.

It is essential to use a ferromagnetic body having an aerodynamic profile whose cross-section diminishes in the direction opposite to that of motion of the article. It is also essential to bring the body into a translatory motion so that the ferromagnetic abrasive powder can flow around the aerodynamic profile of said body and be attracted to the latter, thus restoring the powder density in the working zone.

It is possible to employ a ferromagnetic body in the form of a body of revolution, which is brought into rotation on its axis and into translatory motion along the working zone, these two motions being favourable in restoring the density of the cutting "brush" of ferromagnetic abrasive powder in the working zone.

Other objects and advantages of the present invention will be made more clear with reference to the following description of its particular embodiments taken in conjunction with the accompanying drawings, in which.

The method for finishing external surfaces of non-magnetic articles by means of ferromagnetic abrasive powders in a magnetic field according to the invention is essentially as follows.

Figure 1:
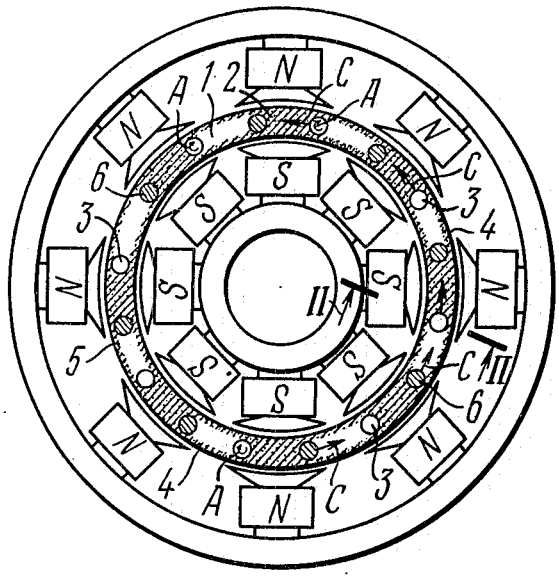
FIG. 1 is a plan view of a rotor-type machine for realizing the method according to the invention.

An external magnetic field is formed by means of unlike, N and S, poles (FIG. 1) of an electromagnetic system, positioned oppositely along the length of a circle.

Figure 2:
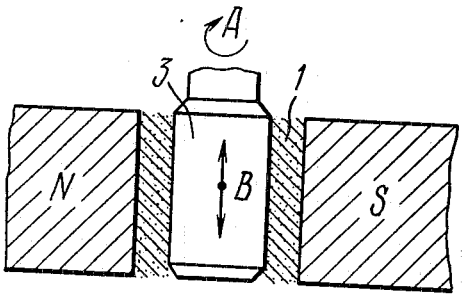
FIG. 2 is a sectional view along line II—II in FIG. 1, shown on an enlarged scale.

Ferromagnetic abrasive powder 1 is introduced into said external magnetic field, thus forming a cutting "brush" of powder which fills a working zone 2 confined between the surfaces of the N and S poles of the electromagnets. Nonmagnetic articles 3, for instance, stomatological instruments, are placed into the working zone 2. The articles 3 are brought into rotating motion along arrow A on their axes, oscillating motion along arrow B (FIG. 2) parallel to their axes, and translatory motion along arrow C (FIG. 1) along the length of an annular zone 4 confined by a chute 5 positioned between the N and S poles of the electromagnets.

The process of treatment of the non-magnetic articles 3 is accompanied by breakage of the cutting "brush" of the powder 1 and by compaction of the latter near the N and S poles of the electromagnets, which impairs the quality of the treated surface of each next article 3 owing to a smaller mass of ferromagnetic abrasive powder in contact with that surface.

To eliminate this drawback, each pair of the non-magnetic articles 3 is separated by a ferromagnetic body 6 (shown hatched), which is brought into a motion that restores the cutting "brush" of the ferromagnetic abrasive powder 1.

Figure 3:
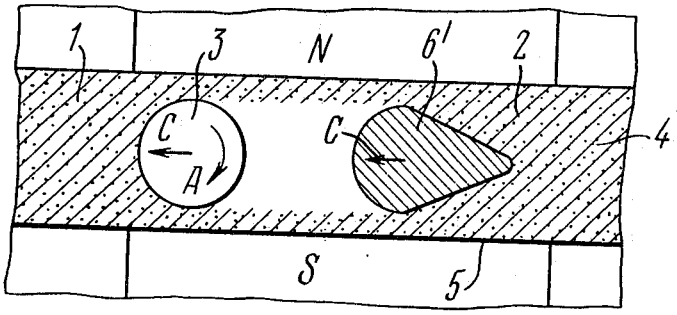
FIG. 3 is a schematic view of a developed portion of the working zone together with an article being treated and a ferromagnetic body of an aerodynamic profile, on an enlarged scale.

When using a ferromagnetic body with an aerodynamic profile 6' (FIG. 3) whose cross-section diminishes in the direction opposite to the direction of motion of the article, it is brought into a translatory motion along arrow C (FIG. 3) along the length of working zone 2.

Figure 4:
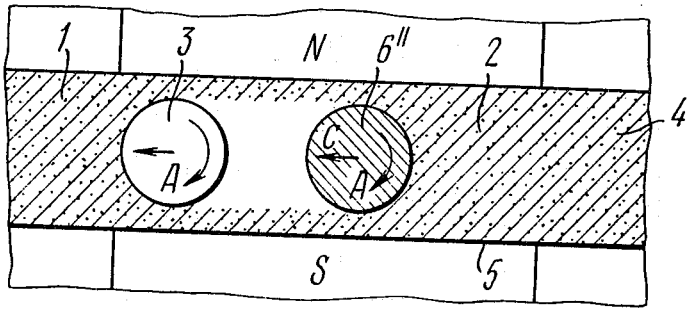
FIG. 4 is a shematic view of a developed portion of the working zone together with an article being treated and a ferromagnetic body of revolution, on an enlarged scale.

Further, a ferromagnetic body in the form of a body of revolution can also be used (6'' in FIG. 4); it is then brought into rotation along arrow A on its axis and into translatory motion along arrow C along the working zone 2.

What is claimed is:

1. A method for finishing surfaces of non-magnetic articles by means of ferromagnetic abrasive powders in a magnetic field which is produced by oppositely positioned unlike poles of a magnetic system, comprising the following: introducing a ferromagnetic abrasive powder in said magnetic field to form a cutting brush from said powder; placing said non-magnetic articles in said magnetic field; causing said articles to be moved relative to said cutting brush; placing a ferromagnetic body between each of said non-magnetic articles and causing said body to move relative to said cutting brush so that the latter is continuously restored.

2. A method as claimed in claim 1, wherein the ferromagnetic body employed has an aerodynamic profile whose cross-section diminishes in the direction opposite to the direction of motion of the non-magnetic article being treated, said body being brought into a translatory motion.

3. A method as claimed in claim 1, wherein the ferromagnetic body employed has a body symmetrical about an axis, said body being brought into rotation on the axis and into a translatory motion.

4. A method as claimed in claim 1, wherein the magnetic field is a stationary magnetic field.

5. A method as claimed in claim 1, wherein the movement of said articles relative to said cutting brush is a combined rotary and translatory movement.

6. A method as claimed in claim 1, wherein said articles are placed in said magnetic field by moving said articles in a direction transverse to said magnetic field.

* * * * *